United States Patent [19]

Parham

[11] Patent Number: 4,896,162

[45] Date of Patent: Jan. 23, 1990

[54] CAPACITANCE LOADED MONOPOLE ANTENNA

[75] Inventor: O. D. Parham, La Habra, Calif.

[73] Assignee: Hughes Aircraft Company, Los Angeles, Calif.

[21] Appl. No.: 26,338

[22] Filed: Mar. 16, 1987

[51] Int. Cl.[4] ..... H01Q 1/36; H01Q 9/36

[52] U.S. Cl. ..... 343/749; 343/846

[58] Field of Search ..... 343/749, 829, 830, 700 MS, 343/846

[56] References Cited

U.S. PATENT DOCUMENTS

| | | | |
|---|---|---|---|
| 3,278,937 | 10/1966 | Leydorf | 343/856 |
| 3,568,206 | 3/1971 | Sisson et al. | 343/750 |
| 3,573,840 | 4/1971 | Gouillou et al. | 343/895 |
| 3,852,760 | 12/1974 | Reggia | 343/830 |
| 3,967,276 | 6/1976 | Goubau | 343/830 |
| 4,070,676 | 1/1978 | Sanford | 343/829 |
| 4,123,758 | 10/1978 | Shibano et al. | 343/830 |
| 4,131,893 | 12/1978 | Munson et al. | 343/700 MS |
| 4,270,128 | 5/1981 | Drewett | 343/702 |
| 4,649,396 | 3/1987 | Friedman | 343/829 |

FOREIGN PATENT DOCUMENTS

| | | | |
|---|---|---|---|
| 60-58704 | 4/1985 | Japan | 343/824 |

*Primary Examiner*—Joseph E. Clawson, Jr.
*Assistant Examiner*—Michael C. Wimer
*Attorney, Agent, or Firm*—Wanda K. Denson-Low

[57] ABSTRACT

An antenna employing a first capacitor formed by a conductive segment disposed above a ground plane and serially connected adjacent capacitors formed over the ground plane. The adjacent capacitors are connected to the ground plane by tuned circuits, resulting in additive coupling of the E fields across the first and adjacent capacitors and the prevention of E field shunting.

26 Claims, 2 Drawing Sheets

CAPACITANCE LOADED MONOPOLE ANTENNA

TECHNICAL FIELD

The subject invention relates to the technical field of communications.

BACKGROUND OF THE INVENTION

1. Field of the Invention

The subject invention relates to antennas and more particularly to a multiple capacitor loaded antenna exhibiting high gain in tight packaging situations.

2. Description of Related Art

The single capacitor loaded monopole antenna is well-known in the prior art. Such an antenna may be visualized as two capacitor plates separated by a dielectric. The effective height of such an antenna is the distance between the plates. Hence, the range of the single monopole antenna of selected plate dimensions can only be increased by increasing the distance between the plates.

In certain applications where a flat or disc shaped antenna of relatively small thickness is required, the single capacitor loaded monopole antenna suggests itself for use. However, the antenna gain available with a single monopole antenna of the requisite small height confines its range to limits which are not practical.

Helical antennas are also known in the prior art and have been suggested for use in compact antennas. Such antennas employ a helical coil wherein gain is achieved by addition of signals in adjacent loops of the helix. See, e.g., U.S. Pat. Nos. 4,121,218 and 4,270,128. Because of their length, helical antennas again are not practical where a flat or disc shaped antenna of small thickness is needed.

Thus, the prior art has lacked an antenna which can provide the gain desired in applications with restrictive packaging requirements, especially those with thin, flat packages. It has appeared to the inventor that adjacent monopole elements could provide additional gain in such an environment. However, no technique of additively coupling such elements has been available. In addition, prior theory has suggested that such additive coupling could not achieve effective increases in antenna height because of predicted shunting out of E fields developed across the capacitive antenna elements.

SUMMARY OF THE INVENTION

Accordingly, it is an object of the invention to increase the effective height of an antenna where packaging space is confined.

It is another object of the invention to provide a structural technique for additively coupling the gain of adjacent capacitor antenna elements of a selected height to achieve gain which exceeds that of a single monopole antenna of the same height.

It is yet another object of the invention to provide an antenna which exhibits improved gain in thin, flat packaging configurations and can be shielded from local radio frequency interference (RFI).

It is still another object of the invention to provide an antenna design adapted to applications where a flat antenna of relatively small thickness is required.

These and other objects are achieved by the invention wherein there is provided an antenna structure including a plurality of serially connected capacitors. A first capacitor is formed from a first conductive layer or plate disposed above a ground plane, and one or more adjacent capacitors are configured from pairs of conductive layers or plates disposed above the ground plane. Additional circuitry is provided to additively couple the gains of the respective capacitors. In one embodiment, the coupling means includes serial connections between the capacitors together with tuned circuits for preventing shunting of the E fields of the adjacent capacitors to ground.

BRIEF DESCRIPTION OF THE DRAWINGS

The just summarized invention will now be described in further detail in conjunction with the drawings of which.

DETAILED DESCRIPTION OF THE PREFERRED EMBODIMENT

Figure 1:
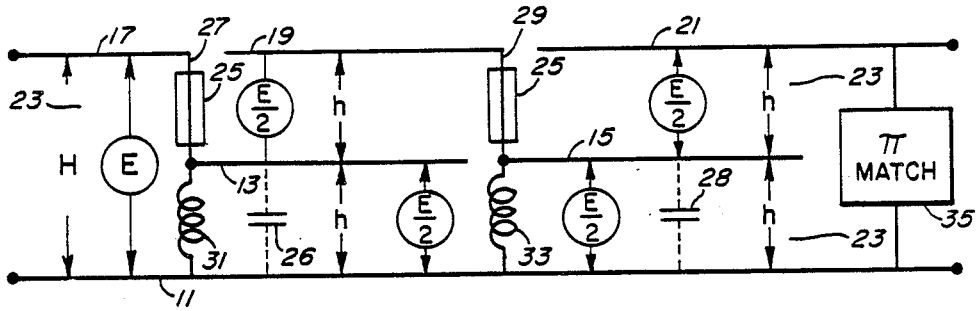
FIG. 1 is a cross sectional diagram of an antenna fabricated according to the preferred embodiment, wherein certain structural features are represented by conventional circuit symbols and others are set forth in physical schematic fashion.

As shown in FIG. 1, the preferred embodiment includes a ground plane 11, above which are disposed a first plurality of relatively thin planar intermediate conductor segments 13, 15 and a second plurality of relatively thin planar upper conductor segments 17, 19, 21. The intermediate segments 13, 15 are disposed adjacent to or laterally from one another at a distance halfway between the ground plane 11 and the upper segments 19, 21.

A suitable dielectric material 23 occupies the space between the conductor segments 13, 15, 17, 19, 21, and the ground plane 11. Fiberglass has been employed as the dielectric in actual embodiments because it can withstand high "g" forces. Other dielectric materials of course may be used. Use of a dielectric with less loss such as Teflon will increase the gain of a particular embodiment, while reducing its ability to withstand "g" forces. Variation of the dielectric constant will not significatly impact antenna performance. In particular, increasing the dielectric constant above the dielectric constant of fiberglass will not increase the antenna aperture although it may shift the center frequency slightly in a tuned configuration because of the change in capacitance.

As will be appreciated, respective capacitors are formed by the upper conductor segment 17 and ground plane 11, the upper conductor segment 19 and the intermediate conductor segment 13, and the upper conductor segment 21 and the intermediate conductor segment 15. The conductor segments 13, 15, 17, 19, 21 thus form "plates" of the capacitors. Location of the intermediate conductor sements 13, 15 halfway between the ground plane and the upper conductor segments 19, 21 has been found to optimize performance. Those skilled in the art will recognize that the structure of FIG. 1 can be readily fabricated as a multilayer printed circuit (PC) board.

Eyelets 25 are inserted in holes in the dielectric 23 to serve as guides for electrical conductors 27, 29. The first conductor 27 connects the first upper conductor segment 17 to the first intermediate conductor segment 13. The second conductor 29 connects the second upper conductor segment 19 to the second intermediate conductor segment 15. The successive capacitors are thus serially connected together.

The first and second intermediate conductor segments 13, 15 are also inductively coupled to the ground plane 11. A first inductor 31 connects the first intermediate conductor segment 13 to ground, while a second inductor 33 connects the second intermediate conductor segment 15 to ground.

The output of the antenna is taken across the third conductor segment 21 and the ground plane 11. A suitable impedance matching (pi) network 35 is connected across these points to provide for efficient power transfer to the following receiver circuitry.

It may be further observed that capacitances 26, 28 exist between the first and second intermediate plates 13, 15 respectively and the ground plane 11 due to their physical separation. The inductors 31, 33 are selected to form tuned circuits with these capacitances 26, 28 with tuning centered at the middle of the passband. The tuned circuits effectively preclude the shunting to ground of E fields predicted by prior art theory by creating a high RF impedance from the intermediate plates 13, 15 to ground. The tuned circuits also contribute a broadband characteristic to the circuit, e.g., 500 Khz in the 2–3 MHz range.

In the preferred embodiment of FIG. 1, the effective height of the antenna is approximately 3H: the distance H between the ground plane 11 and the first upper conductor segment 17, to which is added the distance H between the second upper conductor segment 19 and the ground plane 11, as well as the distance H between the third upper conductor segment 21 and the ground plane 11.

Figure 2:
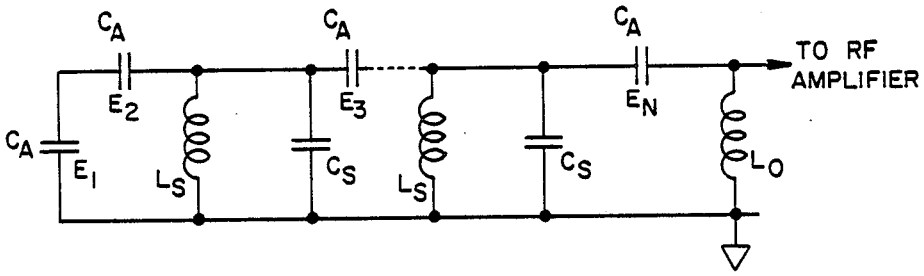
FIG. 2 is an equivalent circuit diagram of the preferred embodiment.

An equivalent circuit of the preferred embodiment is shown in FIG. 2. This circuit includes a number of capacitors $C_A$ connected in series. Tuned circuits comprising the parallel combination of an inductor $L_S$ and capacitor $C_S$ are connected between the series capacitors and ground. Each capacitance $C_A$ represents the capacitance between one of the upper conductive layers 19, 21 and its corresponding intermediate layer 13, 15. The capacitances $C_S$ represent the capacitances between the intermediate layers 13, 15 and the ground plane 11. The inductors $L_S$ represent the inductors 31, 33 of FIG. 1. The $L_SC_S$ tuned circuits prevent shunting out of the E field $E_1$, $E_2$, $E_3$ across the $C_A$ capacitors. The inductance $L_o$ represents the inductance coupling the circuit to an RF amplifier.

Figure 3:
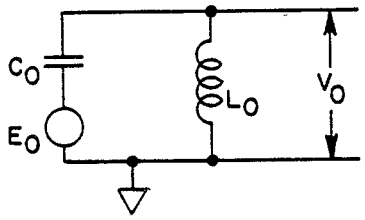
FIG. 3 is a second equivalent circuit of the preferred embodiment.

An equivalent circuit at the center frequency of the circuit of FIG. 2 is shown in FIG. 3. As indicated, the effective capacitance $C_O = KC_A$, where $$K = \frac{1}{N+1}$$

and $$C_A = \frac{\epsilon a}{h},$$

"N" being the total number of capacitors in FIG. 1, "$\epsilon$" being the dielectric constant, "a" the plate area and "h" the distance between the upper and intermediate plates. For the preferred embodiment, N=5. The output voltage Vo equals $QE_o$ where $$Q = \frac{X_{CA}}{NR_o} \text{ and } E_o = (E/2)(N+1)$$

where $X_{CA}$ is the reactance of $C_A$, $R_o$ is the loss of the dielectric, and E is the field strength about the antenna in volts/meter multiplied by 2h/meter. The center frequency ($f_o$) of the antenna is $$f_o = \frac{1}{2\pi\sqrt{L_SC_S}} = \frac{1}{2\pi\sqrt{C_OL_O}}$$

The effective height of the antenna is $$k(N+1)h$$

where k is a constant representing a loss.

Figure 4:
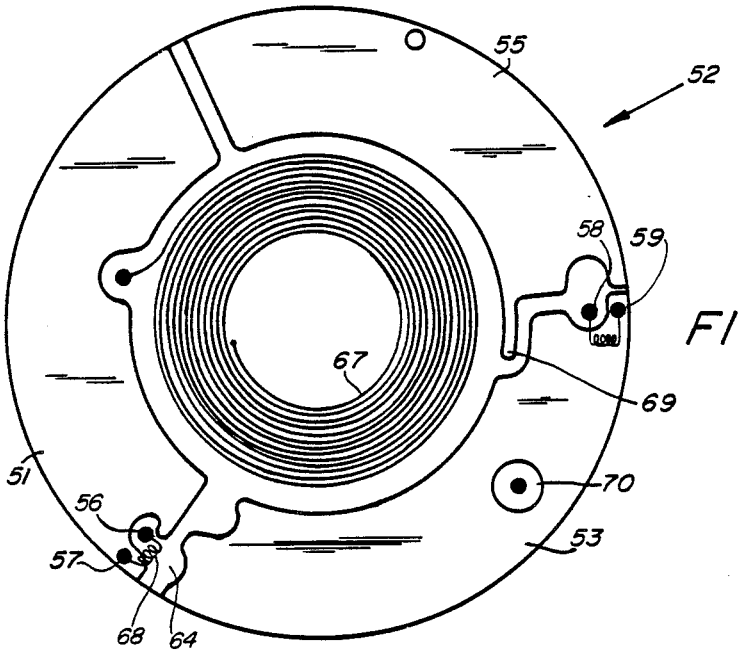
FIG. 4 is a top view of an antenna fabricated according to the preferred embodiment.
Figure 5:
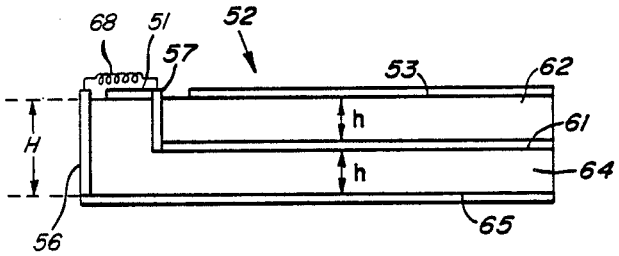
FIG. 5 is a side sectional view of an antenna configured according to the embodiment of FIG. 4.

FIGS. 4 and 5 illustrate a disc-shaped antenna 52 according to the preferred embodiment. FIG. 4 illustrates the upper layer metallization pattern, while FIG. 5 is a schematic illustrative of a cross section of the disc embodiment. This antenna 52 includes three upper annular conductor segments 51, 53, 55. These upper segments correspond functionally to upper segments 17, 19, 21 of FIG. 1 arrayed in a circular configuration. Such conductor segments may be formed by well-known deposition and etching procedures. Eyelets 57, 59 are positioned perpendicularly to the disc surface to connect the upper capacitor segments 51 and 53 to the intermediate segments, e.g., 61 within the circuit board configuration. The two intermediate segments are of the same annular shape as the upper segments 53 and 55 and are located between first and second dielectric layers 62, 64. A ground plane layer 65 is formed as the bottom layer of the disc antenna 52. Eyelets 56 and 58 are positioned perpendicularly to the disc surface and connect the ground plane layer 65 to the dielectric substrate 64 of segments 51, 53, and 55. These eyelets 56 and 58 are located adjacent respective ones of the other eyelets 57 and 59. Chip inductors, e.g., 68 are connected between the eyelets, e.g. 57 and 56 to form the tuned circuit inductances 31, 33 of FIG. 1. The antenna pick-off to the receiver is taken off a finger extension 69 of the metallization, while a pickup 70 provides contact to the ground plane 65. The center of the disc 52 may accommodate a coil 67 for magnetic transmission of signals to circuitry on the opposite side of a circuit board mounting the antenna 52.

An antenna according to FIG. 4 was constructed having a height H of 2.286 mm (0.09 inches) for application in the frequency range of 2–3 MHz. The antenna was packaged around a magnetic transmission coil 67 to feed digital circuitry. The upper segments 51, 53, 55 provided a total area of approximately 61 square centimeters (9½ square inches). The range of such an embodiment showed an increase in range over a single monopole from 1 km to 8 km antenna in desert terrain and from 300 meters to 2–3 km in mountainous terrain. Laboratory tests indicated that an approximate 10 dB gain over the single monopole structure is thus realized.

The design further proved durable and responsive to ground waves, performing satisfactorily even when buried in six inches of mud. The surprising broad bandwidth, omnidirectional characteristic of the preferred embodiment also eliminates the need for adjustable tuning capacitors and their attendant expense. The stepping structure of the invention further provides an antenna which exhibits great flexibility in matching as compared to a single capacitor monopole antenna, which is relatively very difficult to match. The relative ease in matching arises because the stepping structure increases the output impedance of the antenna about three times, e.g. from 10 to 30 milliohms. This increase is significant in common matching situations where the antenna is matched to an impedance in the range of 20 to 30 ohms.

Figure 6:
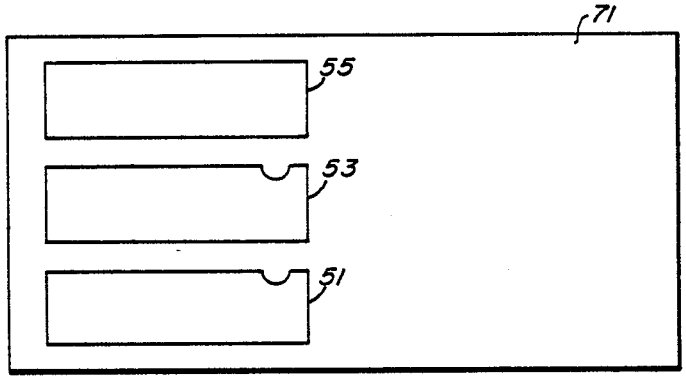
FIG. 6 is an alternate implementation of the preferred embodiment.

FIG. 6 illustrates an alternate embodiment wherein rectangular capacitor segments 51, 53, 55 are arranged adjacent one another on a rectangular circuit board 71, in a linear or matrix array instead of the circular array of FIG. 4. The construction and function of such an array is according to the same structure and principles disclosed above in connection with FIG. 1. The embodiment of FIG. 6 is useful in applications employing standard rectangular circuit cards, whereas the embodiment of FIG. 4 finds use in specialized applications such as installation in radio controlled land mines and other applications having circular symmetry.

A new type of antenna has thus been disclosed which provides unexpected performance results. It will be understood that the principles of design just disclosed may be applied to develop numerous antenna configurations including various numbers of successive capacitor segments in various commercial and military applications, including, for example, vehicle radio antennas. It is therefore to be understood that, within the scope of the appended claims, the invention may be practiced other than as specifically described herein.

What is claimed is:

1. An antenna for receiving an electromagnetic signal, comprising:

means for providing a reference plate;

means for providing a plurality of capacitor plates disposed with respect to said means for providing a reference plate to form a plurality of capacitors for receiving said electromagnetic signal, and thereby developing an E field across each of said capacitors; wherein:

a first capacitor of said plurality of capacitors is formed by said means for providing a reference plate and a first capacitor plate of said means for providing a plurality of capacitor plates;

a second capacitor of said plurality of capacitors is formed by a second capacitor plate of said means for providing a plurality of capacitor plates disposed above said means for providing a reference plate and disposed laterally from and not overlying said first capacitor plate;

a third capacitor of said plurality of capacitors is formed by a third capacitor plate of said means for providing a plurality of capacitor plates disposed above said second capacitor plate and disposed laterally from and not overlying said first capacitor plate; and means for serially coupling selected ones of said plurality of capacitors together such that the E fields of said plurality of capacitors are additively coupled, said means comprising a serial connection between said first capacitor plate and said second capacitor plate, and inductive means coupled between said second capacitor plate and said means for providing a reference plate.

2. The antenna of claim 1 wherein said inductive means comprises an inductor having a value selected to provide a tuned circuit between the said second plate and said reference plate.

3. The antenna of claim 1 further including:

a fourth capacitor of said plurality of capacitors which is formed by a fourth capacitor plate of said means for providing a plurality of capacitor plates disposed above said means for providing a reference plate and disposed laterally from said first capacitor plate; and a fifth capacitor of said plurality of capacitors is formed by a fifth capacitor plate of said means for providing a plurality of capacitor plates disposed above said fourth capacitor plate and disposed laterally from said first capacitor plate;

and wherein said means for coupling said plurality of capacitors together further includes:

a serial connection bewween said third capacitor plate and said fifth capacitor plate; and inductive means coupled between said fourth capacitor plate and said means for providing a reference plate.

4. The antenna of claim 3 wherein said inductive means across said fourth capacitor comprises an inductor having a value selected to provide a tuned circuit between the fourth plate and said reference plate.

5. The antenna of claim 3 wherein the first, third and fifth plates comprise substantially annular segments disposed in a common plane in a circular array above said reference plate.

6. The antenna of claim 5 wherein said second and fourth plates are disposed halfway between said common plane and said reference plate.

7. The antenna of claim 3 wherein the first, third and fifth plates comprise substantially rectangular segments disposed in a common plane in a matrix array above said reference plate.

8. The antenna of claim 7 wherein said second and fourth plates are disposed halfway between said common plane and said reference plate.

9. The antenna of claim 1 wherein said first plate is electrically connected to said second plate.

10. The antenna of claim 9 wherein the electrical spacing between said first plate and said reference plate is approximately twice that between said second plate and said reference plate.

11. The antenna of claim 10 wherein the electrical spacing between the third plate and the second plate is approximately equal to the spacing between the second plate and the reference plate.

12. The antenna of claim 3 wherein said first plate is electrically connected to said second plate and said third plate is electrically connected to said fourth plate.

13. The antenna of claim 12 wherein the electrical spacing between said first plate and said reference plate is approximately twice that between said fourth plate and said reference plate.

14. The antenna of claim 13 wherein the electrical spacing between the fifth plate and the fourth plate is approximately equal to the spacing between the fourth plate and the reference plate.

15. An antenna comprising:

a ground plane means;

a first upper capacitor plate means spaced apart from said ground plane means;

a second upper capacitor plate means spaced apart from said ground plane means;

a first intermediate capacitor plate means positioned between said second capacitor plate means and said ground plane means;

a third upper capacitor plate means;

a second intermediate capacitor plate means positioned between said third upper plate means and said ground plane means;

first conductor means for connecting said first upper plate means to said first intermediate plate means;

second conductor means for connecting said second upper plate means to said second intermediate plate means;

a first inductor means connected between said first intermediate plate means and said ground plane means; and a second inductor means connected between said intermediate plate means and said ground plane means.

16. An antenna for receiving an electromagnetic signal, comprising:

a reference plane;

a first upper capacitor plate spaced apart from said reference plane by a first distance;

a second upper capacitor plate spaced apart from said reference plane by a second distance;

a first intermediate capacitor plate positioned between said second capacitor plate and said reference plane;

a third upper capacitor plate spaced apart from said reference plane by a third distance;

a second intermediate capacitor plate positioned between said third upper plate and said reference plane;

means for electrically connecting said first upper plate to said first intermediate plate;

means for electrically connecting said second upper plate to said second intermediate plate;

a first inductor connected between said first intermediate plate and said reference plane; and a second inductor connected between said second intermediate plate and said reference plane.

17. The antenna of claim 16 wherein the first, second, and third distances are approximately equal and the first and second intermediate plates are disposed approximately halfway between the reference plane and the second and third upper plates respectively.

18. An antenna for receiving an electromagnetic signal, comprising:

means for providing a reference plate;

means for providing a plurality of capacitor plates disposed with respect to said means for providing a reference plate to form a plurality of capacitors for receiving said electromagnetic signal, and thereby developing an E field across each of said capacitors; wherein:

a first capacitor of said plurality of capacitors is formed by said means for providing a reference plate and a first capacitor plate of said means for providing a plurality of capacitor plates;

a second capacitor of said plurality of capacitors is formed by a second capacitor plate of said means for providing a plurality of capacitor plates disposed above said means for providing a reference plate;

a third capacitor of said plurality of capacitors is formed by a third capacitor plate of said means for providing a plurality of capacitor plates disposed above said second capacitor plate;

a fourth capacitor of said plurality of capacitors is formed by a fourth capacitor plate of said means for providing a plurality of capacitor plates disposed above said means for providing a reference plate; and a fifth capacitor of said plurality of capacitors is formed by a fifth capacitor plate of said means for providing a plurality of capacitor plates disposed above said fourth capacitor plate;

means for serially coupling selected ones of said plurality of capacitors together such that the E fields of said plurality of capacitors are additively coupled, said means comprising a serial connection between said first capacitor plate and said second capacitor plate, and inductive means coupled between said second capacitor plate and said means for providing a reference plate, and a serial connection between said third capacitor plate and said fifth capacitor plate, and inductive means coupled between said fourth capacitor plate and said means for providing a reference plate.

19. The antenna of claim 18 wherein said inductive means across said fourth capacitor comprises an inductor having a value selected for providing a tuned circuit between the fourth plate and said reference plate.

20. The antenna of claim 18 wherein the first, third and fifth plates comprise substantially annular segments disposed in a common plane in a circular array above said reference plate.

21. The antenna of claim 20 wherein said second and fourth plates are disposed halfway between said common plane and said reference plate.

22. The antenna of claim 18 wherein the first, third and fifth plates comprise substantially rectangular segments disposed in a common plan in a matrix array above said reference plate.

23. The antenna claim 22 wherein said second and fourth plates are disposed halfway between said common plane and said reference plate.

24. The antenna claim 18 wherein said first plate is electrically connected to said second plate and said third plate is electrically connected to said fourth plate.

25. The antenna claim 24 wherein the electrical spacing between said first plate and said reference plate is approximately twice that between said fourth plate and said reference plate.

26. The antenna of claim 24 wherein the electrical spacing between the fifth plate and the fourth plate is approximately equal to the spacing between the fourth plate and the reference plate.

* * * * *